United States Patent [19]

Schwabe et al.

[11] Patent Number: 5,040,503

[45] Date of Patent: Aug. 20, 1991

[54] AIR AND FUEL DELIVERY APPARATUS

[75] Inventors: Robert J. Schwabe, Milwaukee; James M. Grayson, Pewaukee, both of Wis.

[73] Assignee: Briggs & Stratton Corporation, Skokie, Ill.

[21] Appl. No.: 558,170

[22] Filed: Jul. 25, 1990

[51] Int. Cl.[5] ..... F02B 77/00

[52] U.S. Cl. ..... 123/198 E

[58] Field of Search ..... 123/198 E

[56] References Cited

U.S. PATENT DOCUMENTS

| | | | |
|---|---|---|---|
| 1,873,252 | 8/1932 | Altgelt | 55/DIG. 28 |
| 2,203,407 | 6/1940 | Donaldson | 123/198 E |
| 2,503,934 | 4/1950 | Church | 138/49 |
| 2,528,369 | 10/1950 | Jensen | 285/173 |
| 2,953,216 | 9/1960 | Hight et al. | 183/14 |
| 3,521,726 | 6/1970 | Freyn | 181/33 |
| 3,810,526 | 5/1974 | Kawasaki | 123/198 E |
| 3,919,995 | 11/1975 | Todd | 123/195 A |
| 3,934,992 | 1/1976 | Thompson | 55/324 |
| 4,366,104 | 12/1982 | Miller | 55/DIG. 28 |
| 4,446,822 | 5/1984 | Inaga et al. | 123/41.3 |
| 4,510,739 | 4/1985 | Dluhosch | 123/41.11 |
| 4,594,083 | 6/1986 | Hiraizumi | 55/385 R |
| 4,793,303 | 12/1988 | Nagashima | 123/198 E |
| 4,871,381 | 10/1989 | Smith | 55/385.3 |

FOREIGN PATENT DOCUMENTS 60653 5/1980 Japan .

*Primary Examiner*—Noah P. Kamen

*Attorney, Agent, or Firm*—Andrus, Sceales, Starke & Sawall

[57] ABSTRACT

Apparatus is disclosed that separately delivers air and fuel to an engine carburetor while minimizing the number of components. The fuel tank is integrally formed with the air box and the air filter housing so that the air passageway from the air filter to the carburetor intake is at least partially defined by a common wall between the fuel tank and the air filter housing. The opposite air passageway wall is in part defined by the air filter itself. A flexible, substantially tubular elbow is used to connect the air box outlet to the carburetor intake.

3 Claims, 1 Drawing Sheet

AIR AND FUEL DELIVERY APPARATUS

BACKGROUND OF THE INVENTION

This invention relates to apparatus for delivering air and fuel to a carburetor in an internal combustion engine.

In an internal combustion engine, air and fuel must be delivered to the intake of the carburetor wherein they are mixed in an appropriate ratio for combustion. Many systems are known for delivering air and fuel to the engine carburetor. In one typical prior art system, fuel is delivered from a remote fuel tank through tubing to a carburetor fuel inlet port, while air is similarly transmitted from the air filter through a distinct passageway remote from the fuel tank to another inlet port in the carburetor.

One disadvantage of this prior art system is the relatively large number of components required. Separate components are needed for the fuel tank and the tube used to transmit fuel from the fuel tank to the carburetor; several components are also needed for the passageway used to transfer air from the air filter housing to the carburetor intake.

Other prior art air and fuel delivery systems are known in which air is transmitted from the air filter across fuel in a fuel tank so that the air mixes with fuel vapors before the air/fuel mixture reaches the carburetor. Although the air filter may be located near the fuel tank in such prior art systems, it is often undesirable to premix the air and fuel before they reach the carburetor. Thus, such prior art systems are not suitable for many engine applications.

SUMMARY OF THE INVENTION

Apparatus is disclosed that separately delivers air and fuel to the carburetor in an internal combustion engine while simultaneously eliminating several components required in prior art systems.

The apparatus according to the present invention includes a substantially enclosed fuel tank formed by a plurality of side walls including a first side wall, and a first duct means for carrying fuel from the fuel tank to the carburetor. The apparatus also includes an air passageway means for carrying air from an air filter to the carburetor, the air passageway means having at least a first passageway wall that is substantially integral with the first side wall of the fuel tank. A cover means is also used for retaining the air filter in place.

By forming the major portion of the air passageway integral with the fuel tank, the number of separate components is minimized since the first side wall of the fuel tank is also used to define the air passageway. A second passageway wall opposite the first passageway wall is partially defined by the air filter.

The air passageway means may also include an air box downstream from the air filter that reduces the velocity and changes the direction of the air in the passageway. The air passageway means may include a second duct consisting of a substantially tubular, flexible elbow. The second duct has a first end connected to the air box and a second end connected to the carburetor. The first end preferably has a grommet integral therewith that is inserted into the air box so that the elbow is connected to the air box without the use of retainers or additional parts. Also, the second end of the elbow preferably has a flange and a plate molded integral therewith, the plate being fastened by screws or by a clamp to the carburetor intake.

It is a feature and advantage of the present invention to provide apparatus which separately delivers air and fuel to a carburetor with a minimum number of parts.

It is another feature and advantage of the present invention to provide a fuel tank that is formed integral with—yet is separated from—the air passageway that delivers air to the carburetor intake.

It is yet another feature and advantage of the present invention to provide an air passageway for carrying air from the air filter to the carburetor with the passageway walls being defined by the fuel tank and by the air filter.

These and other features of the present invention will be apparent to those skilled in the art from the following detailed description of the preferred embodiment and the attached drawings, in which:

DETAILED DESCRIPTION OF THE PREFERRED EMBODIMENT

Figure 1:
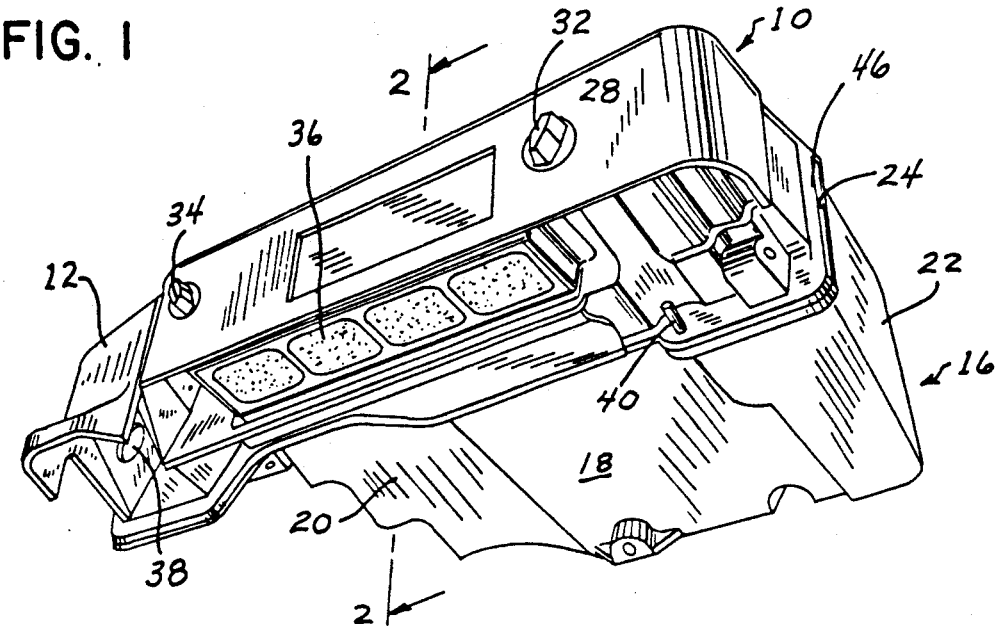
FIG. 1 is a perspective view of the integral fuel tank, air box and air filter housing according to the present invention.
Figure 2:
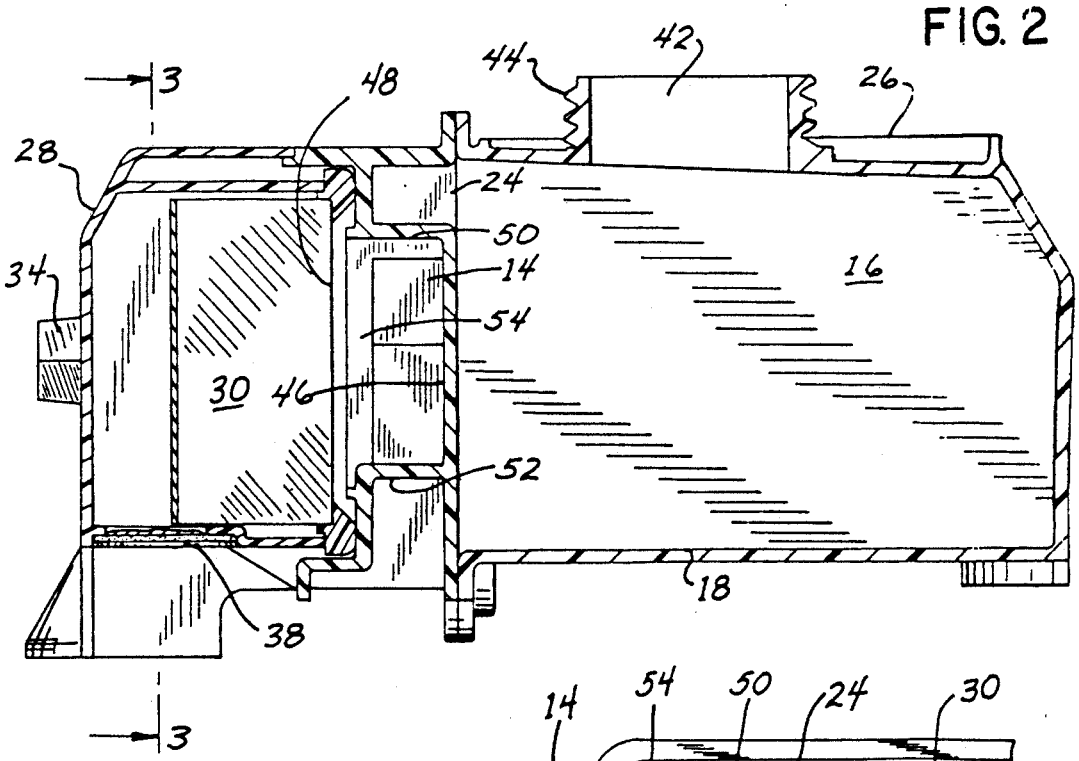
FIG. 2 is a cross-sectional view of the assembly of FIG. 1, taken along line 2—2.

The fuel and air delivery apparatus 10 according to the present invention is depicted in FIGS. 1 and 2 except for the first duct means which carries the fuel from the fuel tank to the carburetor, and the second duct that is connected between air box 12 and the carburetor (not shown). In FIGS. 1 and 2, apparatus 10 includes an air box 12 that collects and changes the direction of air passing through air passageway 14 (FIG. 2). Apparatus 10 also includes an integral fuel tank 16 which is a container formed by a plurality of side walls 18, 20, 22, first side wall 24, and wall 26 (FIG. 2).

Apparatus 10 also includes an air filter cover 28 which retains air filter 30 (FIG. 2) in place, and which itself is retained by two thumb screws 32 and 34.

During engine operation, ambient air passes through a precleaner assembly 36 and then through air filter 30 (FIG. 2). The filtered air then passes through air passageway 14 (FIG. 2) and is forced to change direction in air box 12 before being output through air box outlet 38 (FIG. 1). Outlet 38 is connected via a second duct (not shown) to the intake of a carburetor (not shown).

The second duct is preferably a substantially ,, tubular, flexible elbow having a grommet integral on its first end that is inserted into outlet 38 of air box 12, and having a second end with a flange and an integral plate molded into the flange that is screwed or clamped to the carburetor intake.

At the same time that air is being delivered to the carburetor intake, fuel is being delivered from fuel tank 16 via outlet 40 which in turn is connected via a first duct means or tubing (not shown) directly to an inlet port of the carburetor. As shown in FIG. 2, fuel may be added to fuel tank 16 via a spout 42 which has threads 44 for engaging a threaded fuel tank cap (not shown).

Figure 3:
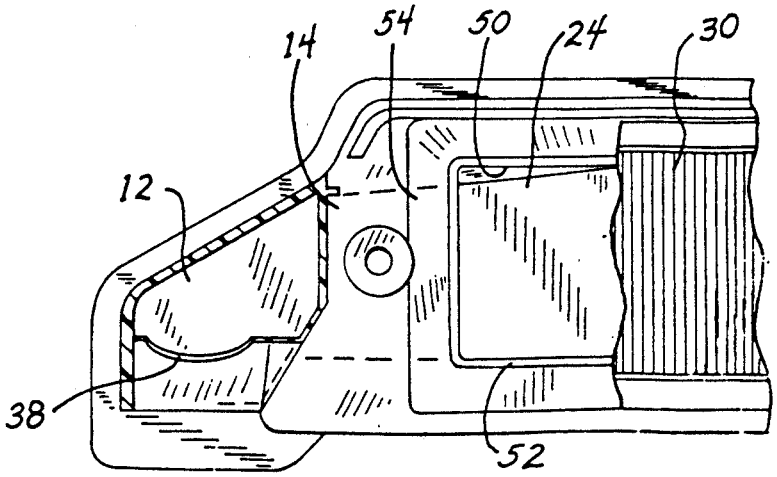
FIG. 3 is a cross-sectional view of the assembly depicted in FIG. 2, taken along line 3—3.

The air passageway 14 which connects air filter 30 with air box outlet 38 is best depicted and described in connection with FIGS. 2 and 3. In FIGS. 2 and 3, air passageway 14 has a first passageway wall 46 which is integral with first side wall 24 of fuel tank 16. As shown in FIGS. 1 and 2, the common wall between fuel tank 16 and passageway 14 consisting of walls 24 and 46 is formed by heat welding fuel tank 16 with the air filter housing during the manufacturing process.

Passageway 14 also has a second passageway wall 48 opposite wall 46. Passageway wall 48 is at least partially defined by air filter 30 (FIG. 2). Passageway 14 is also defined by walls 50, 52 and 54 which together with cover 28 comprise the frame or housing for air filter 30.

Although a preferred embodiment of the present invention has been shown and described, alternate embodiments will be apparent to those skilled in the art and are within the intended scope of the present invention. Therefore, the invention is to be limited only by the following claims.

We claim:

1. Apparatus that separately delivers air and fuel to a carburetor in an internal combustion engine, comprising:

a substantially enclosed fuel tank formed from a plurality of side walls including a first side wall;

first duct means for carrying fuel from said fuel tank to said carburetor; and an air passageway means for carrying air from an air filter to said carburetor, said passageway means having a first passageway wall that is substantially integral and common with said first side wall and having a second passageway wall opposite said first passageway wall that is at least partially defined by said air filter.

2. The apparatus of claim 1, wherein said air passageway means includes an air box that changes the direction of air in said passageway means.

3. The apparatus of claim 1, further comprising:

cover means for retaining said air filter.

* * * * *

UNITED STATES PATENT AND TRADEMARK OFFICE

CERTIFICATE OF CORRECTION

PATENT NO. : 5,040,503

DATED : August 20, 1991

INVENTOR(S) : Robert J. Schwabe et al

It is certified that error appears in the above-identified patent and that said Letters Patent is hereby corrected as shown below:

ON THE TITLE PAGE: Item 73, delete "Skokie, Ill" and substitute therefor ---Wauwatosa, WI---.

Signed and Sealed this

Second Day of March, 1993

*Attest:*

STEPHEN G. KUNIN

*Attesting Officer*

*Acting Commissioner of Patents and Trademarks*